United States Patent [19]

Morin

[11] Patent Number: 4,491,116

[45] Date of Patent: Jan. 1, 1985

[54] BUILT-IN HYDRAULIC AUTOMATIC DEVICE FOR ADVANCING THE INJECTION ON A DIESEL ENGINE

[75] Inventor: Rene Morin, St. Pierre de Boeuf Pelussin, France

[73] Assignee: Renault Vehicules Industriels, France

[21] Appl. No.: 494,586

[22] Filed: May 13, 1983

Related U.S. Application Data

[63] Continuation-in-part of Ser. No. 107,882, Dec. 28, 1979, Pat. No. 4,401,088.

[30] Foreign Application Priority Data

May 14, 1982 [FR] France ..... 82 08869

[51] Int. Cl.[3] ..... F02M 59/20

[52] U.S. Cl. ..... 123/502; 123/501; 464/2

[58] Field of Search ..... 123/501, 502; 464/2, 464/3, 4, 5, 6

[56] References Cited

U.S. PATENT DOCUMENTS 3,650,125 3/1972 Phillips ..... 464/2

3,774,411 11/1973 Phillips et al. ..... 464/2

FOREIGN PATENT DOCUMENTS 491336 10/1955 Italy ..... 464/5

*Primary Examiner*—Magdalen Y. C. Moy

*Attorney, Agent, or Firm*—Remy J. VanOphem

[57] ABSTRACT

A hydraulic automatic device for the injection advance of a diesel engine. The device includes a hub fixed to the pump camshaft and a casing fixed to the drive pinion of the pump. Two rollers in the casing bear on the ramps of pistons, the position of which is a function of the speed of rotation of the device, owing to two inertia blocks, the thrust of the pistons and the control of the slide valve of a hydraulic distributor. Thus at each speed of rotation, there corresponds a certain angular displacement of the components and a certain advance of the injections.

14 Claims, 2 Drawing Figures

BUILT-IN HYDRAULIC AUTOMATIC DEVICE FOR ADVANCING THE INJECTION ON A DIESEL ENGINE

CROSS REFERENCE TO RELATED APPLICATIONS

The present application is a continuation-in-part application of co-pending U.S. patent application Ser. No. 107,882, filed Dec. 28, 1979 and now Pat. No. 4,401,088, which claims the priority date of French Application No. 78 37 109 of Dec. 29, 1978. The present application further claims the priority date of French Application No. 82 08 869, of May 14, 1982, which is an application for a first certificate of addition to above referenced French Application No. 78 37 109. The disclosure of the parent application is hereby incorporated by reference into the present application as if it were reproduced herein in full.

BACKGROUND OF THE INVENTION

The present invention relates to an automatic hydraulic advance for a diesel engine injection pump of the type described in the above referenced parent application. In particular, the present invention concerns an improvement which allows a further increase in the operational stability of the device, even when it is subjected to drive forces which are large, variable or pulsating.

The principle of the device according to the parent application consisted in interposing a mechanism of irreversible operation between the casing 8 of the drive pinion and the hub 7 of the pump camshaft, this irreversible mechanism consisting of two pistons 11 and 12, controlled by a variable hydraulic pressure. The irreversible mechanism consists of an angular assembly including respectively, a lateral oblique ramp 13 and 14, on each piston 11 and 12, bearing on a roller 9 and 10 of the casing 8. Thus any variation controlled by the hydraulic pressure causes without difficulty a sliding of the pistons 11 and 12 in the desired direction, in order to cause the desired angular displacement between the pump camshaft and its drive pinion. On the other hand, the irreversibility of the mechanism makes it impervious to shocks caused on the rollers 9 and 10 by the camshaft, due to the operation of the pump.

Naturally, so that this device operates in a satisfactory manner, it is necessary to maintain the inclined ramps 13 and 14 of the pistons 11 and 12 in contact with and the rollers 9 and 10 of the drive pinion. In the parent application, this retention of contact is insured by two return springs 36 (FIG. 4 of the parent application) permanently stretched between the hub 7 and the casing 8 of the pump.

Experience has shown that if the strength of the operational forces and the speed of rotation of the pump are increased, it is possible to reach a threshold above which the springs 36 become insufficient to maintain contact between the inclined ramps 13, 14 and the rollers 9 and 10 at all times.

SUMMARY OF THE PRESENT INVENTION

The present invention has the objective of avoiding this disadvantage providing by an improvement which allows the diesel engine injection pump to operate satisfactorily in even more difficult conditions.

A device according to the positive means of operation, with twin safeguards to insure irreversibility, such as to maintain the inclined ramps of the control pistons and the rollers of the control casing constantly in contact.

According to one feature of the present invention, a second inclined ramp is provided on the rear of each control piston. This second ramp bears on the rear face of a movable sliding spacer of which the front face, not parallel with the rear face, bears against the roller of the other control piston.

According to another feature of the present invention, the rear face of each spacer and the second inclined ramp corresponding to it on a control piston are both flat, so that the operating play for the bearing of the spacer against its roller varies between two predetermined limits during the working of the automatic advance.

According to another feature of the present invention, the rear inclined face of each spacer has a convex shape, while the second inclined ramp is correspondingly curved on the rear of the corresponding control piston, so that during the operation of the automatic advance, the working play remains practically constant for applying the front face of the spacer against its roller.

BRIEF DESCRIPTION OF THE DRAWINGS

The attached drawing, given by way of non-limiting example, will allow the characteristics of the invention to be better understood.

DETAILED DESCRIPTION OF THE PREFERRED EMBODIMENT

Figure 1:
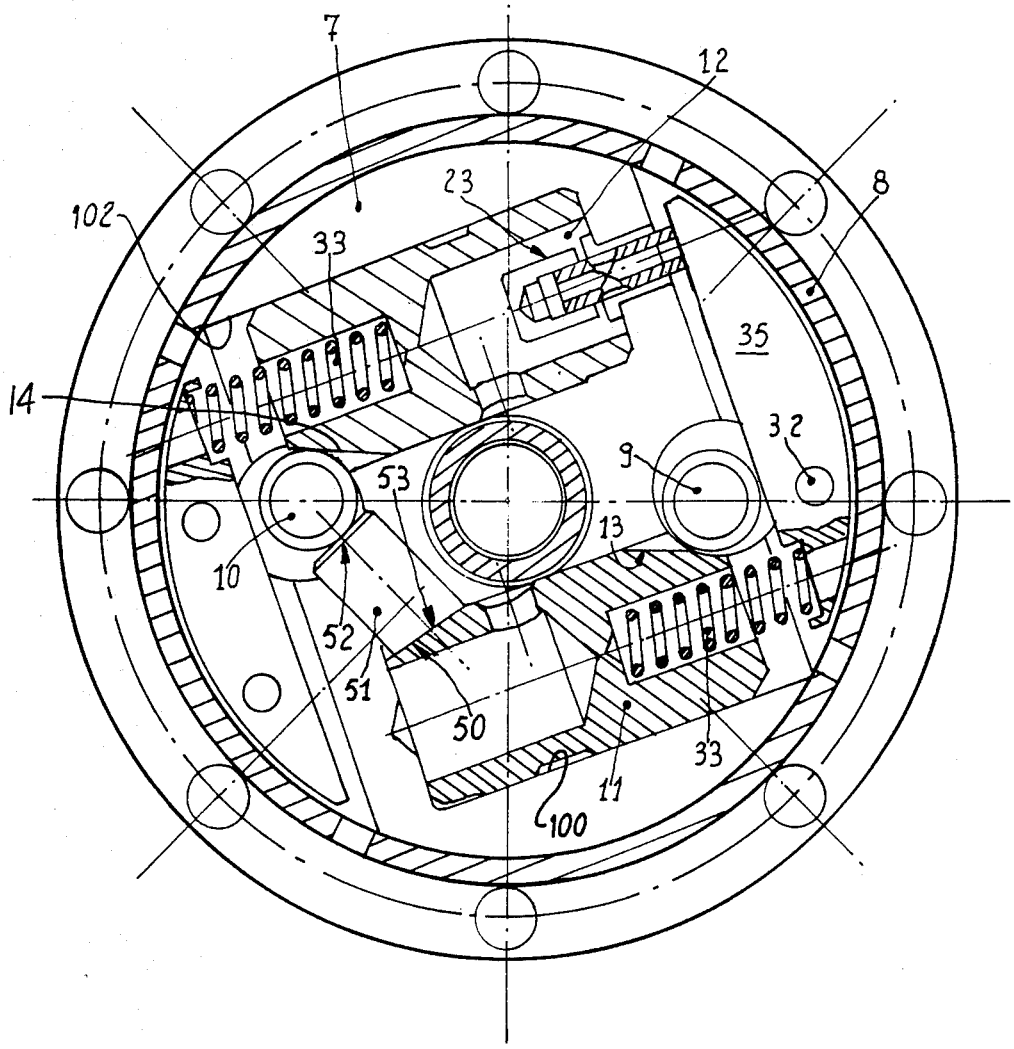
FIG. 1 is a diagrammatic sectional view of the assembly of the device according to the invention, corresponding to FIG. 5 of the parent application.

In the drawings, the same reference numbers as in the parent application have been used to denote the corresponding components.

The angular displacement to be controlled between the casing 8 fixed to the pump drive pinion and the hub 7 fixed to the pump camshaft is defined by the sliding of two control pistons 11 and 12, each of which has on its forward end first inclined ramps 13 and 14, respectively bearing on rollers 9 and 10, respectively. The pistons 11 and 12 slide in bores 100 and 102, respectively, provided for this purpose in the hub 7. The sliding of the pistons causes a wedging effect against the rollers 9 and 10, the shafts of which are fixed to the control casing 8 that renders the operation of the device irreversible.

As in the case of the parent application, the hydraulic pressure applied to the back side of the pistons 11 and 12 against the springs 33 is controlled by the operation of a distributor 23, the slide valve of which is driven by an inertia block 35 pivotally interconnected, as shown at 32, to the hub 7.

The originality of the present invention consists of suppressing the springs (not shown in the drawing but illustrated in FIG. 4 of the parent application) which, in the parent application, were intended to keep each ramp 13 and 14 in contact with its respective roller 9 and 10. It has been determined that under certain conditions of particularly stringent operation these springs 36 tend to malfunction.

The device according to the present invention consists of providing, on at least one of the two control pistons 11 and 12, a second inclined ramp 50 cut laterally near to its rearward end to slidingly engage the rear end of a sliding spacer 51. The sliding spacer 51 has, for example, the shape of a cylinder of revolution truncated by a front face 52 and a rear face 53 which are not parallel to each other. The front face 52 is intended to bear on the corresponding roller 10, while the rear oblique face 53 bears laterally on the second inclined ramp 50 provided at the rearward end of the piston 11. Thus, the spacer 51 is mechanically interposed between the roller 10 of the distributing piston 12 and the rearward end of the other distributing piston 11.

Figure 2:
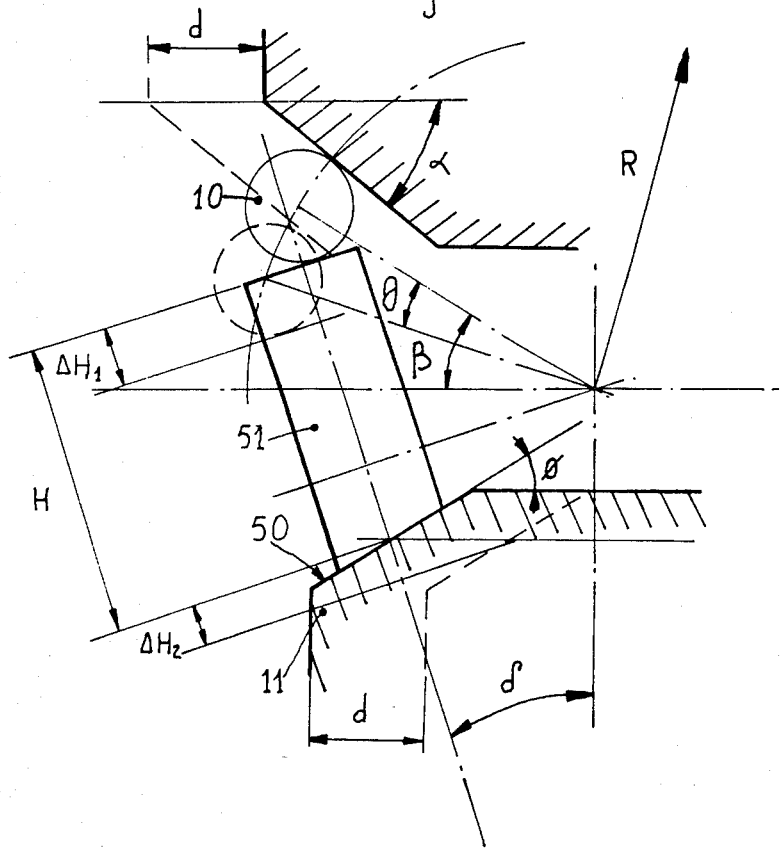
FIG. 2 is a working drawing illustrating the operation and the method of calculation of a spacer according to the invention.

Referring now to the working diagram in FIG. 2, it is clear that the axial distance H measured between the second inclined ramp 50 of the piston 11 and the point of contact against the opposite roller 10 varies during operation of the device, such variation occurring in proportion with the variation of the angle $\theta$. Consequently, it would be a priori impossible to interpose a spacer 51 of constant length between the roller 10 and the second ramp 50. However, and herein lies another novel aspect of the invention, a judicious choice of the dimensions of the various components allows the use of a spacer 51 of effective constant length to be reconciled with the variations of the angle $\theta$.

According to a first example of structure, the angles $\alpha$, $\beta$, $\delta$ and $\phi$ are chosen in such a way that the variation in H in relation to $\theta$ (development of the advance) remains less than a normal operational play, for example, between the face 52 of the spacer 51 and the peripheral surface of the roller 10. Thus the spacer 51, as so dimensioned, remains constantly in contact with the first roller 10 and the second piston 11. When the force couple transmitted by the advance changes sign, the spacer prevents loss of contact between the rollers 9 and 10 and the pistons 11 and 12, thus rendering useless the return springs 36 described in the parent application.

One method of achieving a constant condition H when $\theta$ varies consists of fixing the angles $\alpha$, $\beta$, $\delta$ by considerations of size, of strength of materials and of determining $\phi$ in such a way that the displacement $\Delta H1$ at the level of the first roller, corresponding to a travel d, shall be equal to the displacement $\Delta H2$ at the level of the second piston.

Simple geometrical conditions allow $\Delta H1$ and $\Delta H2$ to be calculated:

$$\Delta H1 = 2R\sin\frac{\theta}{2}\cos\left(\beta + \delta - \frac{\theta}{2}\right)$$

$$\Delta H2 = \frac{2R\sin\frac{\theta}{2}\cos\left(\alpha + \frac{\theta}{2} - \beta\right)\sin\phi}{\sin\alpha \cdot \cos(\delta - \phi)}$$

By equalizing $\Delta H1$ and $\Delta H2$ we arrive at:

$$\cdot\, tg\phi = \frac{\sin\alpha \cdot \cos\delta \cdot \cos\left(\beta + \delta - \frac{\theta}{2}\right)}{\cos\left(\alpha + \frac{\theta}{2} - \beta\right) - \sin\alpha \cdot \sin\delta \cdot \cos\left(\beta + \delta - \frac{\theta}{2}\right)}$$

$\phi$ is calculated by using the value of $\theta$ which corresponds to the maximum development of the advance, and which we will call $\theta$ max.

In these conditions, the spacer will operate with minimum play for $\theta=0$ and $\theta=\theta$max; this operational play will increase for intermediate values of $\theta$.

According to another modification of the present application, the inclined rear ramp 50 of the piston 11 and the rear bearing face 53 of the spacer 51 are given conjugate cylindrical profiles of convex shape such that the variation in operational play of the spacer 51 indicated by the value $\Delta H2-\Delta H1$ when $\theta$ varies will be zero. Thus for all values of $\theta$ lying between 0 and $\theta$max., the operational play of the faces 52 and 53 of the spacer 51 remains constant and therefore may be reduced to a minimum, which will further improve the conditions of operation.

The above constitutes a detailed description of the preferred embodiment of the present invention and is offered by way of example and not by way of limitation. It will be readily appreciated by those skilled in the art that various modifications and variations may be made from the preferred embodiment without departing from the spirit of the present invention or the scope of the claims appended hereto.

What is claimed as novel is as follows:

1. An automatic hydraulic fluid device for advancing the fuel injection pump of a diesel engine in response to engine speed, said diesel engine having a drive pinion and an injection pump having a camshaft with a first central axis, said automatic hydraulic fluid device comprising:

a hub member coaxially mounted to said camshaft of said injection pump for rotation therewith;

a first cavity in said hub member, said first cavity having a second central axis oriented perpendicularly to said first central axis and displaced therefrom a predetermined amount;

a second cavity in said hub member, said second cavity having a third central axis disposed parallel to said second central axis and displaced therefrom twice said predetermined amount and disposed diametrically opposite said second central axis relative to said first central axis;

a first passage in said hub member, said first passage having an inlet and an outlet, said first passage further communicating with said first cavity;

a second passage in said hub member parallel to said first passage but disposed on the opposite side of said first central axis therefrom, said second passage having an inlet and an outlet, said second passage further communicating with said second cavity;

a casing member mounted to said drive pinion for rotation therewith;

a first roller member connected to said casing member, said first roller member having a fourth central axis oriented parallel to said first central axis and spaced away therefrom, said first roller member further being smaller than said first passage and being movably disposed therein;

a second roller member connected to said casing member, said second roller member having a fifth central axis oriented parallel to said first central axis and spaced away therefrom and disposed diametrically opposite said fourth central axis relative to said first central axis, said second roller member further being smaller than said second passage and being movably disposed therein;

a first piston member slidably and sealingly disposed within said first cavity, said first piston member having a forward face and a rearward face opposite said forward face and further dividing said first cavity into a first pressure chamber adjacent said forward face and a second pressure chamber adjacent said rearward face;

a second piston member slidably and sealingly disposed within said second cavity, said second piston member having a forward face and a rearward face opposite said forward face and further dividing said second cavity into a third pressure chamber adjacent said forward face and a fourth pressure chamber adjacent said rearward face;

a first biasing ramp formed in the periphery of said first piston member adjacent said forward face, said first biasing ramp being disposed contiguous to said first roller member for cooperative engagement therewith, said first biasing ramp further being inclined relative to said second central axis from said forward face toward said rearward face such that as said piston member reciprocates along said second central axis, said first biasing ramp slides adjacent said first roller;

a second biasing ramp formed in the periphery of said second piston member adjacent said forward face, said second biasing ramp being disposed contiguous to said second roller member for cooperative engagement therewith, said second biasing ramp further being inclined relative to said third central axis from said forward face toward said rearward face such that as said second piston member reciprocates along said third central axis, said second biasing ramp slides adjacent said second roller member; p1 a third cavity in said hub member, said third cavity having a sixth central axis disposed perpendicular to said first central axis and displaced therefrom, said third cavity having one end opening into said first passage and another end opening into said fourth pressure chamber;

a third piston member movably disposed in said third cavity, said third piston member having a forward face operatively engaging said first roller member and a rearward face opposite said forward face operatively engaging said second piston member;

a fourth cavity in said hub member, said fourth cavity having a seventh central axis disposed parallel to said second central axis and displaced therefrom;

an annular passage centrally located in said hub member and communicating with said fourth cavity; and pressurization means mounted in said fourth cavity, for supplying pressurized fluid to said second pressure chamber in response to said drive pinion rotational speed such that above a predetermined rotational speed of said drive pinion the pressurized fluid in said second pressure chamber forces said first piston member to move outwardly from said first central axis towards said casing member and further the pressurized fluid in said fourth pressure chamber forces said second piston member to move outwardly from said first central axis towards said casing member, whereby said first and second biasing ramps of said first and second piston members move against said first and second roller members, respectively, to move said hub member relative to said casing member and to thereby cause angular displacement therebetween to advance said fuel injection pump of said diesel engine, said third piston member maintaining a predetermined relationship between said first and second piston members.

2. The automatic hydraulic fluid device of claim 1 wherein said pressurization means further comprises:

a distributor member mounted in said fourth cavity of said hub member;

a pivot pin member mounted to said hub member and having an eighth central axis disposed parallel to said first central axis but spaced away therefrom;

an inertia block member pivotally mounted to said pivot pin member, said inertia block member having one end portion operatively engaging said first piston member and another end portion contiguous with said one end portion and operatively engaging said distributor member;

means for connecting said annular passage with said first chamber for flow communication therebetween;

biasing means interposed said first piston member and said one end portion of said inertia block member; and means for supplying pressurized fluid to said annular passage.

3. The automatic hydraulic fluid device of claim 1 wherein said pressurization means further comprises:

a distributor member mounted in said fourth cavity of said hub member;

a pivot pin member mounted to said hub member and having an eighth central axis disposed parallel to said first central axis but spaced away therefrom;

an inertia block member pivotally mounted to said pivot pin member, said inertia block member having one end portion operatively engaging said second piston member and another end portion contiguous with said one end portion and operatively engaging said distributor member;

means for connecting said annular passage with said third chamber for flow communication therebetween;

biasing means interposed said second piston member and said one end portion of said inertia block member; and means for supplying pressurized fluid to said annular passage.

4. The automatic hydraulic fluid device of claim 1 wherein said second piston member further comprises a surface inclined relative to said second central axis and said sixth central axis, said forward face of said third piston member engaging said inclined surface.

5. The automatic hydraulic fluid device of claim 4 wherein said rearward face of said third piston member is inclined relative to said sixth central axis and relative to said third central axis.

6. The automatic hydraulic fluid device of claim 5 wherein said inclined surface and said rearward face remain in cooperative engagement with each other and wherein said forward surface and said first roller member remain in cooperative engagement with each other substantially throughout the displacement of said first and second piston members.

7. The automatic hydraulic fluid device of claim 5 wherein said inclined surface and said rearward face are conjugate arcuate faces such as to minimize the play between said first, second and third piston members.

8. The automatic hydraulic fluid device of claim 5 wherein said inclined surface and said rearward face are disposed at an angle $\phi$ relative to said third predetermined axis selected by the formula $\phi$ is equal to:

$$\phi = \arctan\left[\frac{\sin\alpha \cdot \cos\delta \cdot \cos\left(\beta + \delta - \frac{\theta}{2}\right)}{\cos\left(\alpha + \frac{\theta}{2} - \beta\right) - \sin\alpha \cdot \sin\delta \cdot \cos\left(\beta + \delta - \frac{\theta}{2}\right)}\right]$$

wherein:

alpha is the angle between said first biasing ramp and said second central axis;

delta is the angle between said second central axis and said sixth central axis;

beta is the maximum angle formed between the line parallel to said second central axis passing through said first central axis and the line perpendicular to said second central axis and passing from said first central axis to the center of said first roller member; and theta is the maximum angular displacement of the center of said first roller member about said first central axis.

9. An automatic hydraulic fluid device for advancing the fuel injection pump of a diesel engine in response to engine speed, said diesel engine having a drive pinion and an injection pump having a camshaft with a first central axis, said automatic hydraulic fluid device comprising:

a hub member coaxially mounted to said camshaft of said injection pump for rotation therewith;

a first cavity in said hub member, said first cavity having a second central axis oriented perpendicularly to said first central axis and displaced therefrom a predetermined amount;

a second cavity in said hub member, said second cavity having a third central axis disposed parallel to said second central axis and displaced therefrom twice said predetermined amount and disposed diametrically opposite said second central axis relative to said first central axis;

a first passage in said hub member, said first passage having an inlet and an outlet, said first passage further communicating with said first cavity;

a second passage in said hub member parallel to said first passage but disposed on the opposite side of said first central axis therefrom, said second passage having an inlet and an outlet, said second passage further communicating with said second cavity;

a casing member mounted to said drive pinion for rotation therewith;

a first roller member connected to said casing member, said first roller member having a fourth central axis oriented parallel to said first central axis and spaced away therefrom, said first roller member further being smaller than said first passage and being movably disposed therein;

a second roller member connected to said casing member, said second roller member having a fifth central axis oriented parallel to said first central axis and spaced away therefrom and disposed diametrically opposite said fourth central axis relative to said first central axis, said second roller member further being smaller than said second passage and being movably disposed therein;

a first piston member slidably and sealingly disposed within said first cavity, said first piston member having a forward face and a rearward face opposite said forward face and further dividing said first cavity into a first pressure chamber adjacent said forward face and a second pressure chamber adjacent said rearward face;

a second piston member slidably and sealingly disposed within said second cavity, said second piston member having a forward face and a rearward face opposite said forward face and further dividing said second cavity into a third pressure chamber adjacent said forward face and a fourth pressure chamber adjacent said rearward face;

a first biasing ramp formed in the periphery of said first piston member adjacent said forward face, said first biasing ramp being disposed contiguous to said first roller member for cooperative engagement therewith, said first biasing ramp further being inclined relative to said second central axis from said forward face toward said rearward face such that as said first piston member reciprocates along said second central axis, said first biasing ramp slides adjacent said first roller member;

a second biasing ramp formed in the periphery of said second piston member adjacent said forward face, said second biasing ramp being disposed contiguous to said second roller member for cooperative engagement therewith, said second biasing ramp further being inclind relative to said third central axis from said forward face toward said rearward face such that as said second piston member reciprocates along said third central axis, said second biasing ramp slides adjacent said second roller member;

a third cavity in said hub member, said third cavity having a sixth central axis disposed perpendicular to said first central axis and displaced therefrom, said third cavity having one end opening into said first passage and another end opening into said fourth pressure chamber;

a third piston member movably disposed in said third cavity, said third piston member having a forward face operatively engaging said first roller member and a rearward face opposite said forward face operatively engaging said second piston member;

a fourth cavity in said hub member, said fourth cavity having a seventh central axis disposed parallel to said second central axis and displaced therefrom;

an annular passage centrally located in said hub member and communicating with said fourth cavity; and pressurization means mounted in said fourth cavity, for supplying pressurized fluid to said second pressure chamber in response to said drive pinion rotational speed such that above a predetermined rotational speed of said drive pinion the pressurized fluid in said second pressure chamber forces said first piston member to move outwardly from said first central axis towards said casing member and further the pressurized fluid in said fourth pressure chamber forces said second piston member to move outwardly from said first central axis towards said casing member, whereby said first and second biasing ramps of said first and second piston members move against said first and second roller members, respectively, to move said hub member relative to said casing member and to thereby cause angular displacement therebetween to advance said fuel injection pump of said diesel engine, said third piston member maintaining a predetermined relationship between said first and second piston members; said pressurization means further comprising:

a distributor member mounted in said fourth cavity of said hub member;

a first pivot pin member mounted to said hub member and having a eighth central axis disposed parallel to said first central axis and spaced away therefrom;

a second pivot pin member mounted to said hub member and having a ninth central axis disposed parallel to said first central axis and spaced away therefrom;

a first inertia block member pivotally mounted to said first pivot pin member, said first inertia block member having one end portion operatively engaging said first piston member and another end portion contiguous with said one end portion and operatively engaging said distributor member;

a second inertia block member pivotally mounted to said second pivot pin member, said second inertia block member having one end portion operatively engaging said second piston member and another end portion contiguous with said one end portion and operatively engaging said distributor member;

means for connecting said annular passage with said first pressure chamber for flow communication therebetween;

means for connecting said annular passage with said third chamber for flow communication therebetween;

first biasing means interposed said first piston member and said one end portion of said first inertia block member;

second biasing means interposed said second piston member and said one end portion of said second inertia block member; and means for supplying pressurized fluid to said annular passage.

10. The automatic hydraulic fluid device of claim 9 wherein said second piston member further comprises a surface inclined relative to said second central axis and said sixth central axis, said forward face of said third piston member engaging said inclined surface.

11. The automatic hydraulic fluid device of claim 10 wherein said rearward face of said third piston member is inclined relative to said sixth central axis and relative to said third central axis.

12. The automatic hydraulic fluid device of claim 11 wherein said inclined surface and said rearward face remain in cooperative engagement with each other and wherein said forward face and said first roller member remain in cooperative engagement with each other substantially throughout the displacement of said first and second piston members.

13. The automatic hydraulic fluid device of claim 12 wherein said inclined surface and said rearward face are conjugate arcuate faces such as to minimize the play between said first, second and third piston members.

14. The automatic hydraulic fluid device of claim 13 wherein said inclined surface and said rearward face are disposed at an angle $\phi$ relative to said third predetermined axis selected by the formula $\phi$ is equal to:

$$\phi = \arctan\left[\frac{\sin\alpha \cdot \cos\delta \cdot \cos\left(\beta + \delta - \frac{\theta}{2}\right)}{\cos\left(\alpha + \frac{\theta}{2} - \beta\right) - \sin\alpha \cdot \sin\delta \cdot \cos\left(\beta + \delta - \frac{\theta}{2}\right)}\right]$$

wherein:

alpha is the angle between said first biasing ramp and said second central axis;

delta is the angle between said second central axis and said sixth central axis;

beta is the maximum angle formed between the line parallel to said second central axis passing through said first central axis and the line perpendicular to said second central axis and passing from said first central axis to the center of said first roller member; and theta is the maximum angular displacement of the center of said first roller member about said first central axis.

* * * * *

UNITED STATES PATENT AND TRADEMARK OFFICE

CERTIFICATE OF CORRECTION

PATENT NO. : 4,491,116

DATED : January 1, 1985

INVENTOR(S) : Rene Morin

It is certified that error appears in the above-identified patent and that said Letters Patent is hereby corrected as shown below:

Column 1, line 37, after "including" insert a comma ---- , ----.

Column 1, line 50, delete "and".

Column 1, line 67, after "the" insert ---- present invention has a ----.

Column 5, line 37, delete "pl" and insert a paragraph indention.

Column 8, line 41, delete "inclind" and insert ---- inclined ----.

Signed and Sealed this

*Fourth* Day of *June 1985*

[SEAL]

*Attest:*

DONALD J. QUIGG

*Attesting Officer* *Acting Commissioner of Patents and Trademarks*